US006450323B1

(12) United States Patent
Agier et al.

(10) Patent No.: US 6,450,323 B1
(45) Date of Patent: Sep. 17, 2002

(54) DEVICE FOR CONVEYING FLAT OBJECTS PROCESSING EQUIPMENT ITEMS

(75) Inventors: François Agier, Bourg-les Valence; Florence Duval, Magny-les-Hameaux; Dominique Decharran, Bourg-les-Valence, all of (FR)

(73) Assignee: Mannesmann Dematic Postal Automation, Gentilly (FR)

( * ) Notice: Subject to any disclaimer, the term of this patent is extended or adjusted under 35 U.S.C. 154(b) by 0 days.

(21) Appl. No.: 09/869,036

(22) PCT Filed: Dec. 20, 1999

(86) PCT No.: PCT/EP99/10101

§ 371 (c)(1),
(2), (4) Date: Aug. 7, 2001

(87) PCT Pub. No.: WO00/39010

PCT Pub. Date: Jul. 6, 2000

(30) Foreign Application Priority Data

Dec. 24, 1998 (FR) ..... 98 16426

(51) Int. Cl.[7] ..... B65G 15/12
(52) U.S. Cl. ..... 198/626.1; 271/2
(58) Field of Search ..... 198/626.1, 626.4, 198/606, 604, 620; 271/2, 149, 150, 272, 274

(56) References Cited

U.S. PATENT DOCUMENTS

| | | | | |
|---|---|---|---|---|
| 4,431,179 A | | 2/1984 | Westover | |
| 4,696,392 A | | 9/1987 | Chisholm | |
| 5,046,713 A | * | 9/1991 | Cargill | 271/149 |
| 5,074,540 A | * | 12/1991 | Belec et al. | 271/2 X |
| 5,197,729 A | | 3/1993 | Couper | |
| 6,170,820 B1 | * | 1/2001 | Hutson | 271/272 X |

FOREIGN PATENT DOCUMENTS

| | | | | |
|---|---|---|---|---|
| DE | 1 103252 | * | 3/1961 | 198/626.1 |
| DK | 62299 | * | 5/1944 | 198/626.1 |
| EP | 0 509 428 A | | 10/1992 | |
| LA | 1063056 | * | 9/1979 | 198/626.1 |

* cited by examiner

*Primary Examiner*—James R. Bidwell
(74) *Attorney, Agent, or Firm*—Sughrue Mion, PLLC

(57) ABSTRACT

Device for conveying flat objects (1), held vertically, at high speed between processing equipment items, and in particular for conveying mail envelopes. This device comprises: a stationary baseplate (3) extending from one equipment item to the other, a motorized reference belt (4) stretched over a set of vertical pulleys (7) and extending above the baseplate along the conveying path between equipment items; a motorized press belt (5) mounted in such a way that it can be pressed against the reference belt along the conveying path; a series of defonnable wheels (6) along the conveying path between equipment items, which can come to bear against the press belt in the zone where the latter presses against the reference belt, so as to grip the conveyed envelopes appropriately in spite of the differences in thickness between envelopes.

5 Claims, 2 Drawing Sheets

DEVICE FOR CONVEYING FLAT OBJECTS PROCESSING EQUIPMENT ITEMS

BACKGROUND OF THE INVENTION

The invention relates-to a device for conveying flat objects, held vertically, at high speed along one of their long dimensions and one after another, between processing equipment items in an installation, and in particular for conveying mail envelopes of varying size in a postal sorting installation.

The conveying of flat objects, one after another, between two items of processing equipment, is currently achieved using an endless belt on which the flat objects are placed in succession. However, such conveying is unsatisfactory when the objects have to be presented vertically, for example for direct reading at a sorting station, and an arrangement for changing the orientation of the objects has then to be provided.

Another known solution for conveying flat objects one after another is obtained by using a motorized corridor between the processing equipment items that are to be connected. This corridor comprises a base belt on which the flat objects are placed edge-on, because of their weight, and two lateral belts between which the flat objects pass in succession in order to be conveyed. The mechanical arrangement needed to operate a motorized corridor has the drawback of being relatively complicated and it is known that this solution is not very appropriate when soft objects are to be found among the succession of flat objects, of different sizes, conveyed at high speed between processing equipment items.

An alternative version of the solution for conveying flat objects one after another mentioned hereinabove envisages holding the flat objects by gripping them between a broad lateral belt, which serves as a reference, against which the flat objects are pressed, and a narrow lateral press belt. For this, the press belt is pressed against the broad reference belt by mobile rotary pulleys spread out along that part of the

SUMMARY OF THE INVENTION conveying path which is followed by both of the belts between two processing equipment items. Here again, the mechanical arrangement needed has the drawback of being relatively complicated and the solution adopted is suited only to a small range of differences in thickness between successive flat objects.

In order to overcome these drawbacks, the invention therefore proposes a device for conveying flat objects, held vertically, at high speed in a movement along one of their long dimensions and one after another, between processing equipment items, and in particular for conveying mail envelopes of varying size in a postal sorting installation.

According to one feature of the invention, the device comprises:

- a stationary baseplate extending from one equipment item to another to allow the envelopes, resting on their edge, to slide;
- a broad motorized endless reference belt stretched over a set of vertical pulleys mounted on fixed axles and extending, in particular, above the baseplate, along the edge of which this belt extends along the conveying path between equipment items, so as to provide lateral support for the envelopes in a vertical position;
- a motorized endless press belt mounted on a set of vertical pulleys with fixed axles in such a way that it can be pressed against the reference belt along the conveying path between equipment items followed by this reference belt, so as to grip the envelopes introduced between the latter belt and itself at one end of the conveying path followed;
- a series of free and elastically deformable wheels, mounted on fixed vertical axles along the conveying path between equipment items, so as to come to bear against the press belt in the zone where the latter presses against the reference belt, so as, by elastic deformation, to grip all the envelopes conveyed appropriately in spite of the differences in thickness there may be between these envelopes.

According to one feature of the invention, the wheels are longitudinally offset with respect to the pulleys of the set carrying the reference belt along the conveying path between equipment items.

According to one feature of the invention, the spacing between wheels and between pulleys is shorter than the intended spacing between two objects being conveyed one after the other.

According to one feature of the invention, at least one fixed guide is mounted so that it is parallel, along the conveying path followed by the belts between the equipment items, so as to provide support to the upper parts of the envelopes being conveyed at least on that side on which these envelopes are gripped by the press belt.

According to one feature of an alternative form of the invention, several guides are mounted in parallel at different heights along the conveying path followed by the belts between the equipment items, so as to provide support to the upper parts of the envelopes being conveyed, according to the height of these envelopes, and at least on that side where the press belt grips them.

BRIEF DESCRIPTION OF THE DRAWINGS

The invention, its characterstics and its advantages are specified in the description which follows in conjunction with the figures mentioned hereinbelow.

DETAILED DESCRIPTION OF THE INVENTION

Figure 1:
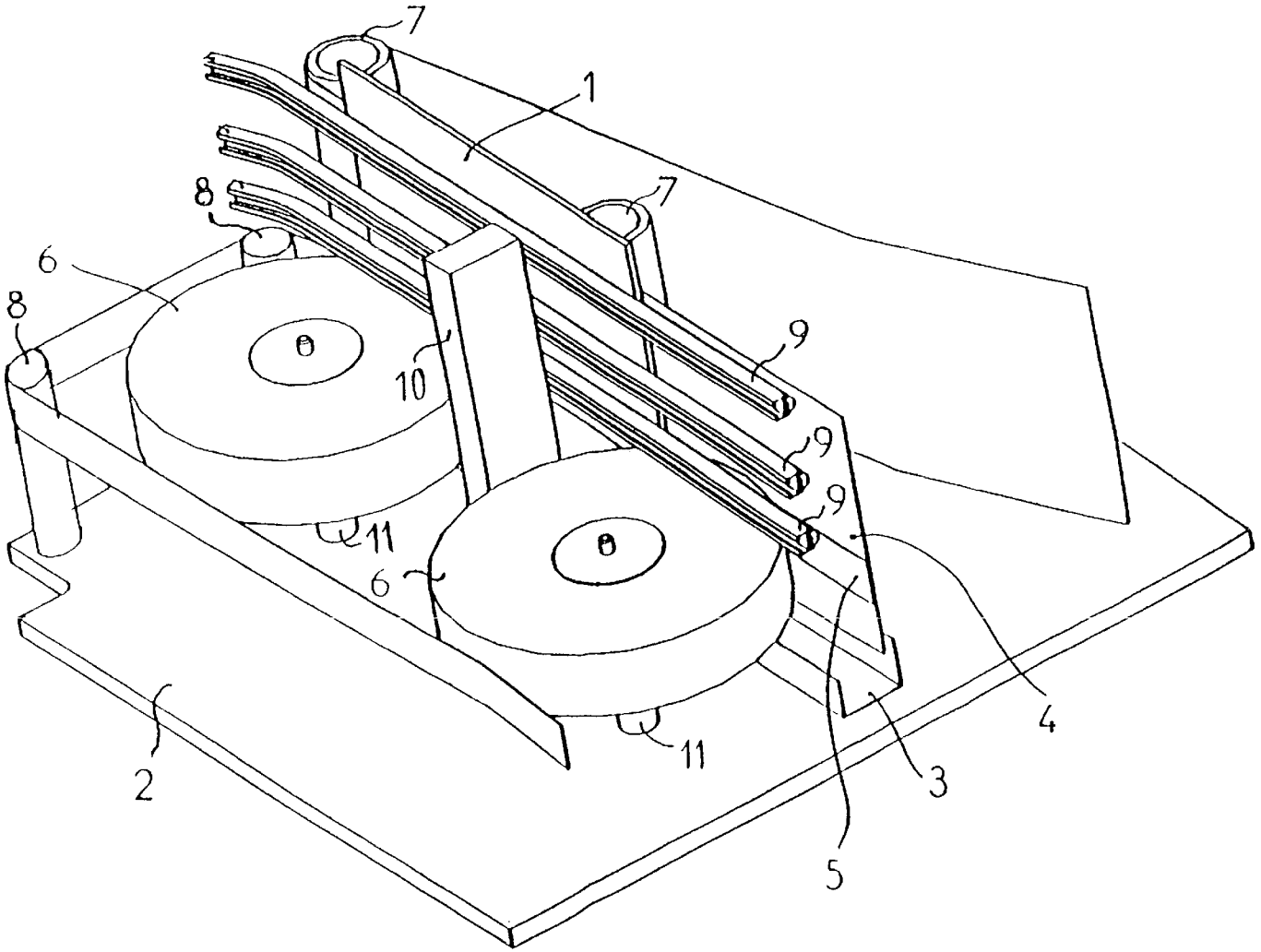
FIG. 1 diagrammatically depicts the essential elements of a conveying device according to the invention, viewed in perspective.

The conveying device according to the invention, illustrated partially in FIG. 1, is intended to move flat objects 1, of rectangular appearance and varying dimensions, such as postal envelopes, between two object-processing equipment items of an installation, not depicted. It allows the objects to be conveyed, at high and constant speed, in a vertical position and one after another, in a movement along one of their two long dimensions.

The envisaged objects are, for example, envelopes, the usual dimensions of which are between 140 and 400 millimeters long, 90 and 300 millimeters wide, and between 0.15 and 32 millimeters thick. The may possibly be relatively soft, although in general they are more or less rigid.

The device according to the invention is, in this instance, assumed to be mounted on a mounting plate 2. It essentially comprises a set of elements consisting of a baseplate 3, a reference belt 4, a press belt 5 and a series of elastically deformable wheels 6, some of these elements being depicted only in part in the figures. The assembly is designed to extend between the two equipment items of the installation between which the flat objects are to be conveyed. The distance between these equipment items is not a truly critical factor, but is not usually very long and generally does not exceed a few meters. The baseplate 3 is designed to allow the envelopes resting on their edge thereon to slide via their lower end as they travel from one equipment item to the other; in this particular instance it is assumed to be of profiled shape with a U-shaped cross section.

The reference belt 4 is a motorized fixed-back endless belt mounted in the conventional way on a set of vertical pulleys. This set includes idler pulleys such as the pulleys 7 and drive pulleys, not depicted, and allows the belt to be kept firmly taut. This belt provides reference support for the envelopes conveyed along the length of the path that these envelopes take between the equipment item transmitting them and the one receiving them. It is arranged vertically above the baseplate, along the edge of which it extends along the aforementioned path between equipment items. This reference belt is preferably relatively wide so as to provide the flat objects with good support of one of their two large faces and so as to keep these objects vertical while they are being conveyed. This width is, for example, of the order of 200 millimeters in the case of the objects of the aforementioned dimensions.

The press belt 5 is intended to keep the flat objects pressed against the reference belt while they are being conveyed. This is a motorized endless belt mounted over a set including vertical pulleys such as 8 and 8', which may or may not be driven, around which it is stretched. This belt, which is preferably narrow, presses against the reference belt along the aforementioned path between equipment items and above the baseplate.

The press belt 5 is pressed against the reference belt 4, for example, in the central lower part of this reference belt, as shown in FIG. 1. This is achieved by the action of a series of elastically deformable free wheels 6 mounted on fixed and vertical axles 11. Each of these wheels presses against the press belt in the zone where this belt presses against the reference belt on the other side of this press belt with respect to this reference belt. The wheels 6 are made, in a way known to the person skilled in the art, to absorb, by elastic deformation, the differences in thickness there are likely to be between the flat objects and more particularly between two flat objects placed one after the other and in order to remain pressed against the press belt constantly even when there is no flat object between the two belts at their respective locations.

These wheels are, for example, spoked wheels, of the low-pressure type, made of polyurethane, of the type produced by the company COURBIS, these wheels having, for example, a diameter of the order of 250 millimeters and width of 50 millimeters.

In a preferred embodiment, the wheels 6 are longitudinally offset from the pulleys 7 along the path between equipment items traveled by the two belts 4 and 5 pressed against each other. The spacings of the wheels 6 and of the pulleys 7 is preferably chosen to be slightly shorter than the intended spacing between two objets placed one after the other so as to guarantee that all objects conveyed between the two belts 4 and 5 will be gripped correctly.

It is also intended that there be mounted at least one fixed guide 9, parallel to the path followed by the two belts between the equipment items, to act as a support for the upper part of the envelopes conveyed when the envelopes tend to bend over on the side on which they are least supported heightwise during conveying, this side being the side where these envelopes are gripped by the narrow press belt.

In the embodiment proposed, there are three parallel guides 9 borne by posts 10 fixed to the mounting plate 2, to provide support for envelopes of different heights. This or these guides, of the rail type, are mounted in such a way that they extend along the path along which the objects are conveyed by the belts at a distance from the reference belt 4 which is slightly greater than the maximum envisaged thickness of an object.

Figure 2:
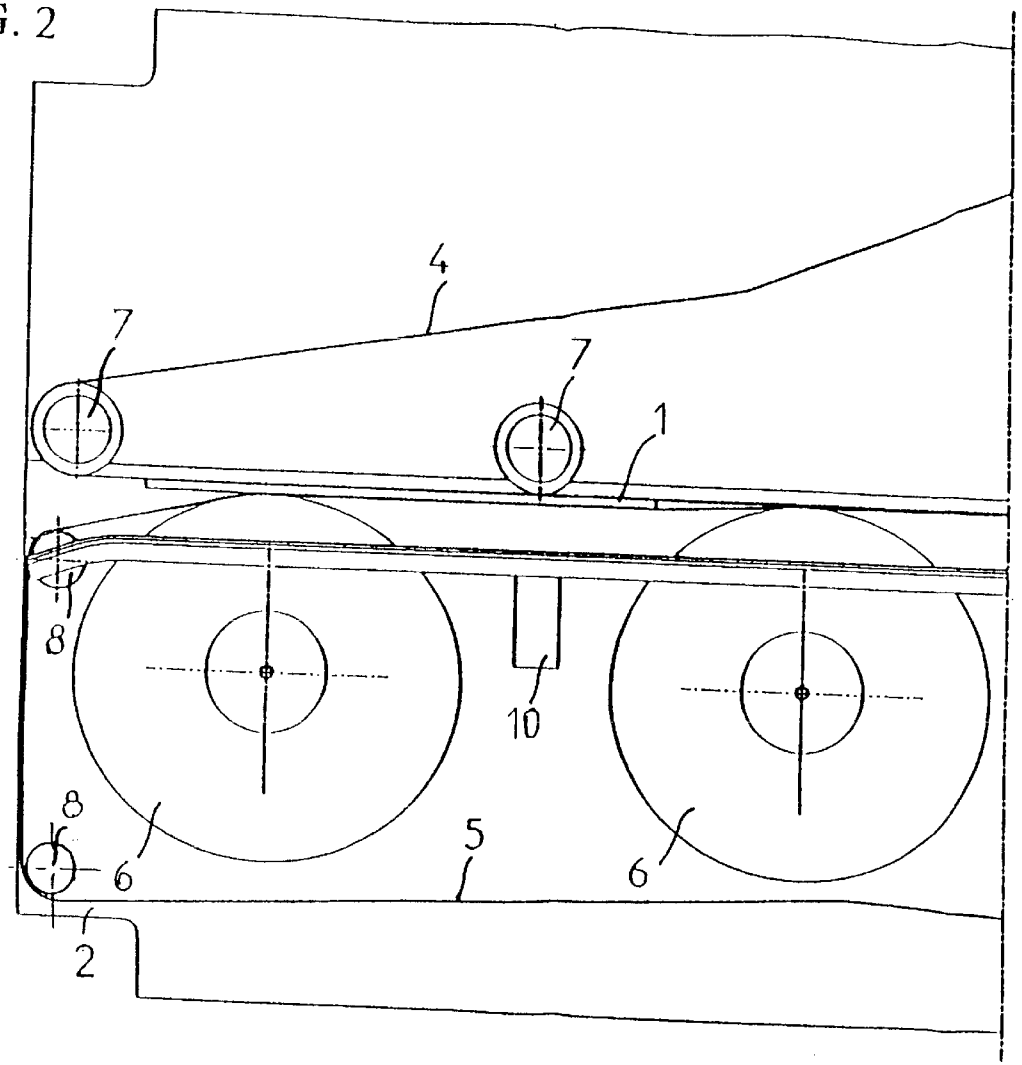
FIG. 2 depicts a view from above of the device illustrated in FIG. 1.

The device therefore allows a succession of flat objects presented vertically to be conveyed along one of their two long dimensions, to an inlet of the device situated, for example, between the two adjacent pulleys 7 and 8 visible at the left-hand end of the device as depicted in FIG. 2. Each flat object 1 is inserted between the two belts 4 and 5 between which it is immediately gripped, its passage past one of the wheels 6 causing temporary crushing of this wheel because of its thickness, without significant deformation of the reference belt 4, because of the tension therein. At the same time as being inserted between the belts 4 and 5, each flat object becomes inserted between the reference belt 4 and one and/or other of the guides 9, depending on the height by which it projects above this belt. It therefore moves along resting along one of the guides as it is conveyed from one equipment item to another, if it does not have enough rigidity to remain vertical by itself.

The device according to the invention has the advantage of corresponding to a simple assembly which is produced using a small number of standard components mounted statically. This assembly also has the advantage of not requiring articulations between moving parts. It can therefore be produced economically and exhibit great reliability.

What is claimed is:

1. A device for conveying flat objects (1), held vertically, at high speed in a movement along one of their long dimensions and one after another, between processing equipment items, and in particular for conveying mail envelopes of varying size in a postal sorting installation, which device essentially comprises:

a stationary baseplate (3) extending from one equipment item to the other to allow the conveyed envelopes, resting on their edge, to slide;

a broad motorized endless reference belt (4) stretched over a set of vertical pulleys (7) and extending, in particular, above the baseplate, along the edge of which this belt, resting on pulleys (7) of fixed axle, extends along the conveying path between equipment items, so as to provide lateral support for the envelopes in the vertical position;

a motorized endless press belt (5) mounted on a set of vertical pulleys (8) in such a way that it can be pressed against the reference belt along the conveying path between equipment items followed by this reference belt, so as to grip the envelopes introduced between the latter belt and itself at one end of the conveying path followed;

a series of free and elastically deformable wheels (6), mounted on fixed vertical axles along the conveying path between equipment items, so as to come to bear against the press belt in the zone where the latter presses against the reference belt.

2. The device as claimed in claim 1, wherein the wheels are longitudinally offset with respect to the pulleys of the set carrying the reference belt along the conveying path between equipment items.

3. The device as claimed in claim 2, wherein the spacing between wheels and between pulleys is shorter than the intended spacing between two objects being conveyed one after the other.

4. The device as claimed in claim 1, wherein at least one fixed guide (9) is mounted so that it is parallel, along the conveying path followed by the belts between the equipment items, so as to the provide support to the upper parts of the envelopes being conveyed.

5. The device as claimed in claim 4, wherein several guides (9) are mounted in parallel at different heights along the conveying path followed by the belts between the equipment items, so as to provide support to the upper parts of the envelopes being conveyed, according to the height of these envelopes, and at least on that side where the press belt grips them.

* * * * *